US008328055B1

(12) United States Patent
Snyder

(10) Patent No.: US 8,328,055 B1
(45) Date of Patent: Dec. 11, 2012

(54) WRIST HOLDER FOR A SMARTPHONE OR PERSONAL DIGITAL ASSISTANT

(76) Inventor: Zenda Snyder, New York, NY (US)

( * ) Notice: Subject to any disclaimer, the term of this patent is extended or adjusted under 35 U.S.C. 154(b) by 210 days.

(21) Appl. No.: 12/984,712

(22) Filed: Jan. 5, 2011

Related U.S. Application Data

(60) Provisional application No. 61/336,196, filed on Jan. 19, 2010.

(51) Int. Cl.
*A45F 3/14* (2006.01)
*A45F 5/00* (2006.01)

(52) U.S. Cl. ..... 224/197; 224/219; 224/222; 224/267; 224/930

(58) Field of Classification Search ..... 224/197, 224/199, 218, 219, 222, 267, 901.4, 930
See application file for complete search history.

(56) References Cited

U.S. PATENT DOCUMENTS

| | | | | |
|---|---|---|---|---|
| 4,214,688 | A * | 7/1980 | Griffin, Jr. | 224/197 |
| 5,274,613 | A | 12/1993 | Seager | |
| 5,412,545 | A * | 5/1995 | Rising | 362/105 |
| 6,360,928 | B1 * | 3/2002 | Russo | 224/218 |
| 6,726,070 | B2 * | 4/2004 | Lautner | 224/221 |
| 6,880,737 | B2 * | 4/2005 | Bauer | 224/246 |
| D545,564 | S | 7/2007 | Davis | |
| D548,457 | S * | 8/2007 | Reinerio | D3/218 |
| 7,424,110 | B1 | 9/2008 | Whiten, III | |
| 7,529,155 | B2 * | 5/2009 | Fasciano | 368/10 |
| 7,942,293 | B2 * | 5/2011 | Lawrence et al. | 224/218 |
| 2002/0139822 | A1 * | 10/2002 | Infanti | 224/197 |
| 2004/0057578 | A1 | 3/2004 | Brewer | |
| 2006/0176660 | A1 | 8/2006 | Amiri | |
| 2006/0196902 | A1 * | 9/2006 | Chen et al. | 224/197 |
| 2006/0237494 | A1 * | 10/2006 | Fichera | 224/197 |
| 2008/0054039 | A1 | 3/2008 | Wulff et al. | |
| 2008/0110946 | A1 * | 5/2008 | Dixon et al. | 224/197 |
| 2009/0039121 | A1 * | 2/2009 | Paul | 224/222 |
| 2009/0069045 | A1 | 3/2009 | Cheng | |
| 2009/0321483 | A1 * | 12/2009 | Froloff | 224/267 |
| 2010/0032462 | A1 * | 2/2010 | Cameron et al. | 224/222 |
| 2010/0327030 | A1 * | 12/2010 | Yang | 224/199 |
| 2012/0080462 | A1 * | 4/2012 | Hajarian | 224/219 |
| 2012/0138647 | A1 * | 6/2012 | Norling | 224/267 |

* cited by examiner

*Primary Examiner* — Nathan J Newhouse
*Assistant Examiner* — Lester L Vanterpool
(74) *Attorney, Agent, or Firm* — Goldstein Law Offices, P.C.

(57) ABSTRACT

A holder for a handheld device such as a smartphone or personal digital assistant (PDA) worn securely on a wrist, that allows the device to selectively rotate to a plurality of desired positions while remaining on the wrist. The holder has a protective shell case rotatably connected to a wrist strap by a pair of interlocking assemblies. In a first embodiment, a spring assembly with a pair of tabs on the wrist strap connects to a socket assembly attached to the shell case. In a further embodiment, the socket assembly on the strap connects to the spring assembly on the case. The shell case holds the device, allowing a user to directly access and use the device single-handedly when worn on the wrist. The device rotates between portrait and landscape positions by grasping the shell case and twisting, and detaches quickly by squeezing the tabs, disengaging the interlocking assemblies.

15 Claims, 4 Drawing Sheets

WRIST HOLDER FOR A SMARTPHONE OR PERSONAL DIGITAL ASSISTANT

CROSS-REFERENCE TO RELATED APPLICATIONS

This application is a nonprovisional utility application of the provisional patent application, Ser. No. 61/336,196 filed in the United States Patent Office on Jan. 19, 2010 and claims the priority thereof.

BACKGROUND OF THE INVENTION

The invention relates generally to a wrist holder for a smartphone or a personal digital assistant (PDA). More particularly, the invention relates to a holder for a handheld device such as a smartphone or a PDA that is worn securely on a wrist by a user, that allows the device to selectively rotate to a plurality of desired positions.

Since their introduction in the late twentieth century, so-called smartphones have become increasing popular among cell phone users. Similarly, millions of personal digital assistants, sometimes called palmtop computers or PDA's, have been sold since their introduction around the same time. What are common to both types of devices are their expanded flat screens, virtual or actual keyboards, and the ability to connect wirelessly to the Internet and other devices.

Growth in demand for advanced mobile devices such as smartphones, boasting powerful processors, abundant memory, expanded display screens, open operating systems, and limitless number of applications, has outpaced the rest of the mobile phone market for several years. Smartphones and PDA's have become irreplaceable parts of people's day-to-day lives. These are more than luxury items to many people who rely on them not just to communicate via a phone call, as in the case of smartphones, but to take pictures and videos, access calendars and address books, check email, surf the web, perform office tasks and develop business documents with mobile versions of word processors and spreadsheets, locate areas of interest and avoid traffic jams with GPS, play games, and entertain with music and video downloads. Included in this group of smartphones and PDAs are, for example, but not limited to, the Apple® iPhone® and iPod Touch® (Apple®, iPhone® and iPod Touch® are registered trademarks of Apple, Inc., Cupertino, Calif.), the RIM® Blackberry® (RIM® and Blackberry® are registered trademarks of Research In Motion Limited, Waterloo, Ontario CAN), and the Palm® Treo® Pro and Pre® (Palm®, Treo® and Pre® are registered trademarks of Palm, Inc., Sunnyvale, Calif.).

While these handy devices solve many problems for the user, they also have created new issues. Typically, the user grasps the device in both hands, and uses the thumbs to work the keyboards or cursor. Alternatively, the user holds the device in one palm and uses the other hand with or without a stylus to operate. Regardless of the method of operation, the user must use both hands to input data into the device.

Smartphones and PDAs, unlike simple cellphones, often use different display orientations or modes for different applications, sometimes referred to as a page orientation. Page orientation is the way in which a rectangular page is oriented for normal viewing. The two most common positions are portrait and landscape. Portrait orientation refers to the fact that a close-up portrait of a person's face and upper body is more fitting for a canvas or photo, where the height of the display area is greater than the width. Portrait orientation is more common for the pages of books and documents. Portrait display is preferred for editing documents to view the entire page on the screen. Portrait is also the standard form of display for simple cellphones.

Landscape originally described artistic outdoor scenes where a wide view area is needed, but generally refers to a view with a width greater than the height. Landscape orientation is commonly used to display video. Some smartphone and PDA applications can be displayed in either orientation, depending how the user is holding the device. Other applications can only be displayed in one preferred orientation, so the device user must be able to freely rotate back and forth between the two orientation modes.

While these devices are seemingly indispensable, ironically they are also fragile. These devices are also vulnerable to damage from dust and water, as well as from being dropped or inadvertently banged against a hard surface. Some users slip the device into a shirt pocket, only to watch it fall out when they bend over to retrieve something from the floor. Most users buy a protective holder, such as a case, a "skin," or a shell for their digital device to protect it from damage.

Another major concern for users is losing the device. Approximately one in five mobile phone users lose or experience the theft of their cellphone yearly. Not only is the useful tool itself lost, but also there are data stored on these devices that might not be stored elsewhere. A serious concern is that an unscrupulous individual might be able to access confidential data or use the phone to make expensive overseas calls. Many users try to solve this problem by putting the device in a holder or case and wearing it on their belt to keep it close to them. However, for women who wear dresses, skirts, and pants that do not have belts, this does not solve the issue.

Perhaps the most important need for the user is accessibility, especially when the user is performing other tasks. Walking down the street, talking on the smartphone or listening to music, the user has to awkwardly carry the device in their hand. If the user is using an umbrella or carrying many bags, having the device in hand is especially inconvenient. Tossing the device into a bag creates other problems. Once in the bag, the smartphone becomes elusive, hiding in and around the contents of the bag. If the user is wearing the device on a belt or around the neck, outerwear interferes with accessing the device. When the user is riding a bicycle or driving a car, he or she needs to quickly see who is calling without taking their eyes off the road, without fumbling around outer clothing or bags, backpacks or purses.

Users typically attach their smartphone or PDA to their belt by a loop, by a clip, or by a hanging clasp. To use the device, the user must detach the phone or PDA from the belt. Some wear it clipped to a wrist loop or neck strap. When worn on a wrist loop, the device and loop strap must be removed from the wrist to use it, which often requires two hands. The neck strap allows the device to bounce against the sternum of the wearer, which can cause pain. Once detached, the device is again defenseless against loss, theft and damage. Some have installed tracking software to prevent loss or aid in recovery, if the device has GPS capability.

Wrist straps and bracelets for cellphones and PDA's have been proposed previously. Some do not allow the user to use the device without removing it from the strap. Others allow the user to use the device while wearing it, but only in the upright or "portrait" position. The smartphone device or cell phone must be used in speaker mode only because the device does not easily detach for use as a traditional handset with a receiver and microphone. Others integrate a customized cellphone or a PDA into the bracelet itself, but the devise is fixed in position.

While these units may be suitable for the particular purpose employed, or for general use, they would not be as suitable for the purposes of the present invention as disclosed hereafter.

SUMMARY OF THE INVENTION

It is an object of the invention to produce a holder for a handheld computing device such as a smartphone or a PDA (personal digital assistant), that prevents loss or theft of the device. Accordingly, the invention is a wrist holder that securely attaches the device to a user's wrist.

It is another object of the invention to produce a holder for a handheld computing device such as a smartphone or a PDA, that is easily accessible when needed. Accordingly, the invention is a wrist holder that attaches the device by a back surface to a user's wrist, allowing a front display to be accessed instantly.

It is a further object of the invention to produce a holder for a handheld computing device such as a smartphone or a PDA, that prevents damage to the handheld device when in use. Accordingly, the invention is a holder that has a protective shell case that fits around the device, and attaches to a user's wrist.

It is an additional object of the invention to produce a holder for a handheld computing device such as a smartphone or PDA, that allows the user to only use one hand to operate the device. Accordingly, the invention is a holder that is worn on a wrist of the user, and frees up a hand distally attached to the wrist to perform other tasks.

It is yet another object of the invention to produce a holder for a handheld computing device such as a smartphone or a PDA, that allows the user to quickly detach it from its holder. Accordingly, the invention has a pair of tabs that operate by a quick squeeze with a thumb and a forefinger, to quickly release and detach the device for further use.

It is a yet a further object of the invention to produce a holder for a handheld computing device such as a smartphone or a PDA, that allows the user to use it in various orientations. Accordingly, the invention is a holder that attaches to a wrist strap using interlocking assemblies that allow the device to rotate between a portrait and a landscape position.

The invention is a holder for a handheld device such as a smartphone or personal digital assistant (PDA) worn securely on a wrist, that allows the device to selectively rotate to a plurality of desired positions while remaining on the wrist. The holder has a protective shell case rotatably connected to a wrist strap by a pair of interlocking assemblies. In a first embodiment, a spring assembly with a pair of tabs on the wrist strap connects to a socket assembly attached to the shell case. In a further embodiment, the socket assembly on the strap connects to the spring assembly on the case. The shell case holds the device, allowing a user to directly access and use the device single-handedly when worn on the wrist. The device rotates between portrait and landscape positions by grasping the shell case and twisting, and detaches quickly by squeezing the tabs, disengaging the interlocking assemblies.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
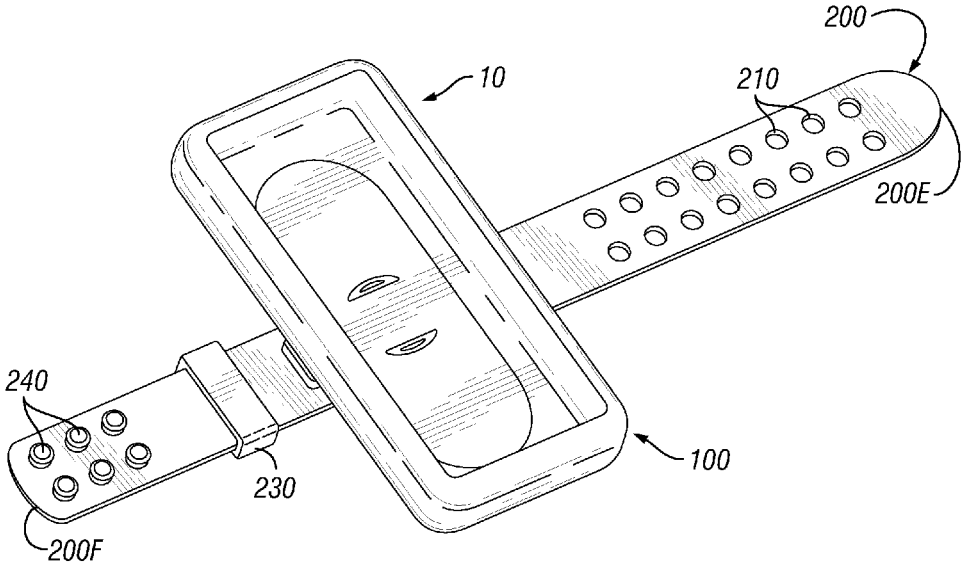
FIG. 1 is a diagrammatic perspective view of the invention from the front, showing an empty shell case attached to a wrist strap.

FIG. 1 illustrates a wrist holder 10 for a handheld computing device such as a smartphone or a PDA (personal digital assistant) according to the present invention. The invention has a wrist strap 200 which is adjustable lengthwise to snugly fit around a user's wrist to accommodate different sized wrists. The wrist holder 10 has a shell case 100 to securely cradle the handheld device that is rotatably mounted on the wrist strap 200 by a spring assembly interlockingly connected to a socket assembly. The spring assembly selectively connects to and disconnects from the mounting assembly. When the spring assembly is connected to the socket assembly, the shell case 100 containing the handheld device selectively rotates to any position that a user requires. The shell case 100 protects the handheld device particularly when the device is disconnected from the wrist strap 200, preventing damage if the device is dropped, but also protects the device if struck against a hard surface when mounted on the wrist strap 200.

Figure 5:
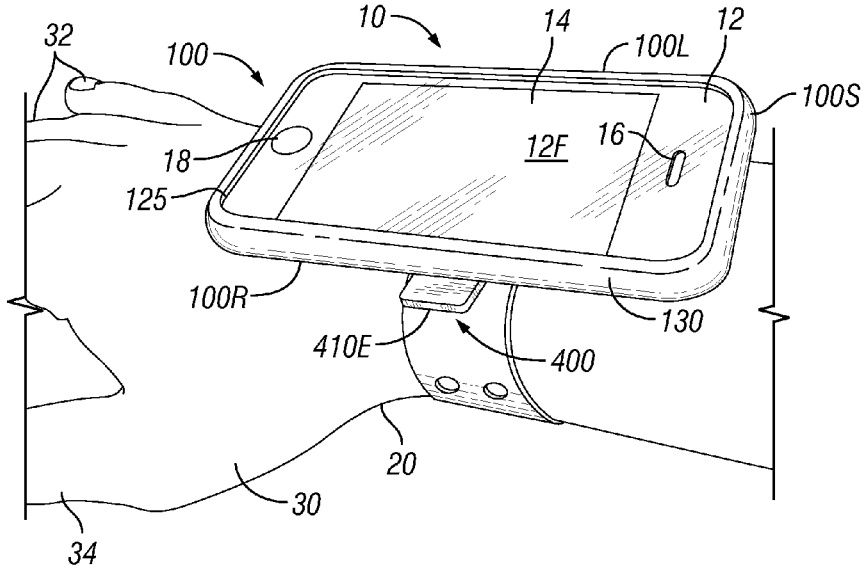
FIG. 5 is a diagrammatic perspective view of the invention in use, showing a smartphone in place on a wrist of a user, with the smartphone in a landscape position.
Figure 6:
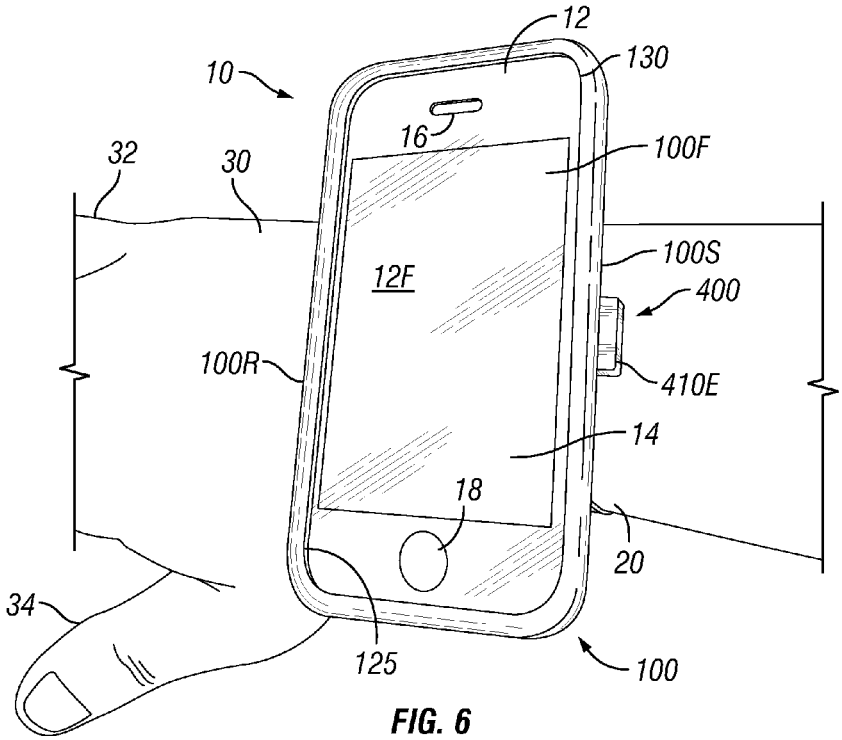
FIG. 6 is a diagrammatic perspective view of the invention in use, showing a smartphone in place on a wrist of a user, with the smartphone in a portrait position.

FIG. 5 illustrates a user wearing the wrist holder 10 with a handheld computing device 12 in place on the user's wrist 20, the device in a landscape position, having the width of the display area greater than the height of the display. In FIG. 6, the user has selectively rotated the device 12 into a portrait position, having the height of the display area greater than the width of the display, without removing the device 12 from the user's wrist 20. The device 12 is functional in both the landscape and portrait position.

Figure 2:
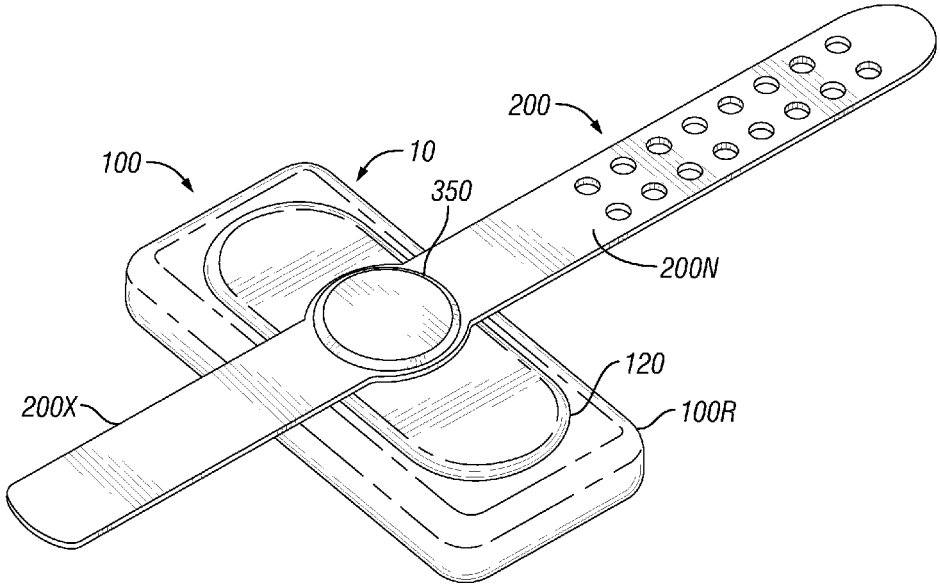
FIG. 2 is a diagrammatic perspective view of the invention from the back, showing the shell case attached to the wrist strap.

FIG. 2, the fully assembled invention 10 is illustrated from the rear, showing the wrist strap 200, having an inside 200N and an outside. The inside 200N of the strap 200 rests against the user's wrist. The shell case 100 has a rear 100R with a platform 120 to provide sufficient clearance between the strap 200 and the shell case 100 for the spring assembly to connect to the socket assembly and rotate. The inside 200N of the wrist strap 200 is smooth to fit snugly and comfortably around the user's wrist. In a first embodiment, a flat crown 350 on the inside 200N fastens the socket assembly on the outside 200X of the wrist strap 200. In a further embodiment, the inside 200N of the wrist strap 200 is solid and smooth, the spring assembly directly attached on the outside 200X of the strap 200.

Figure 3:
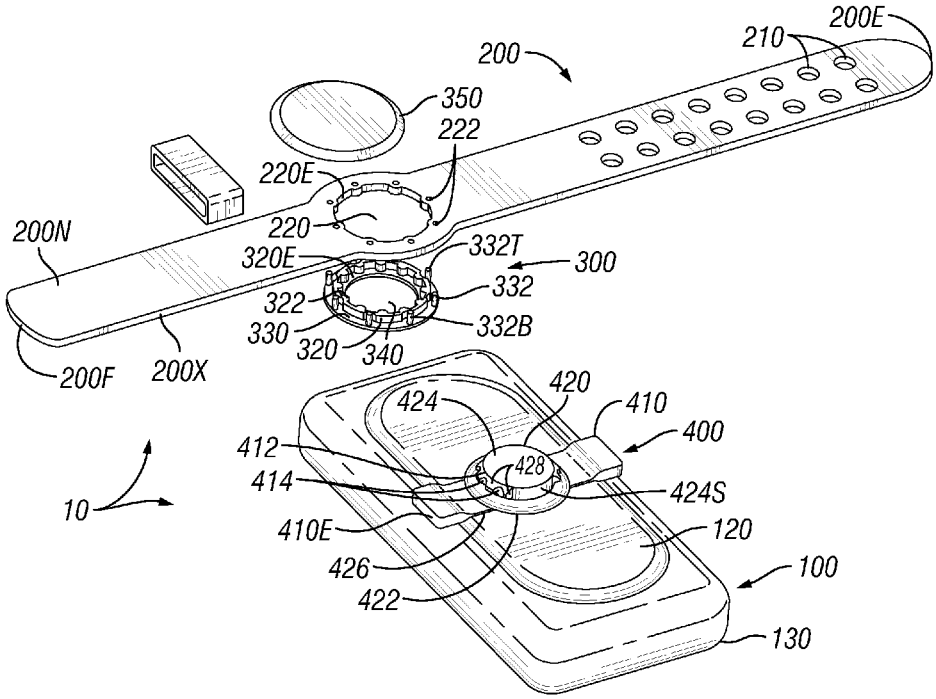
FIG. 3 is a diagrammatic perspective view of a first embodiment of the invention from the back, showing an exploded view of a socket assembly.
Figure 7:
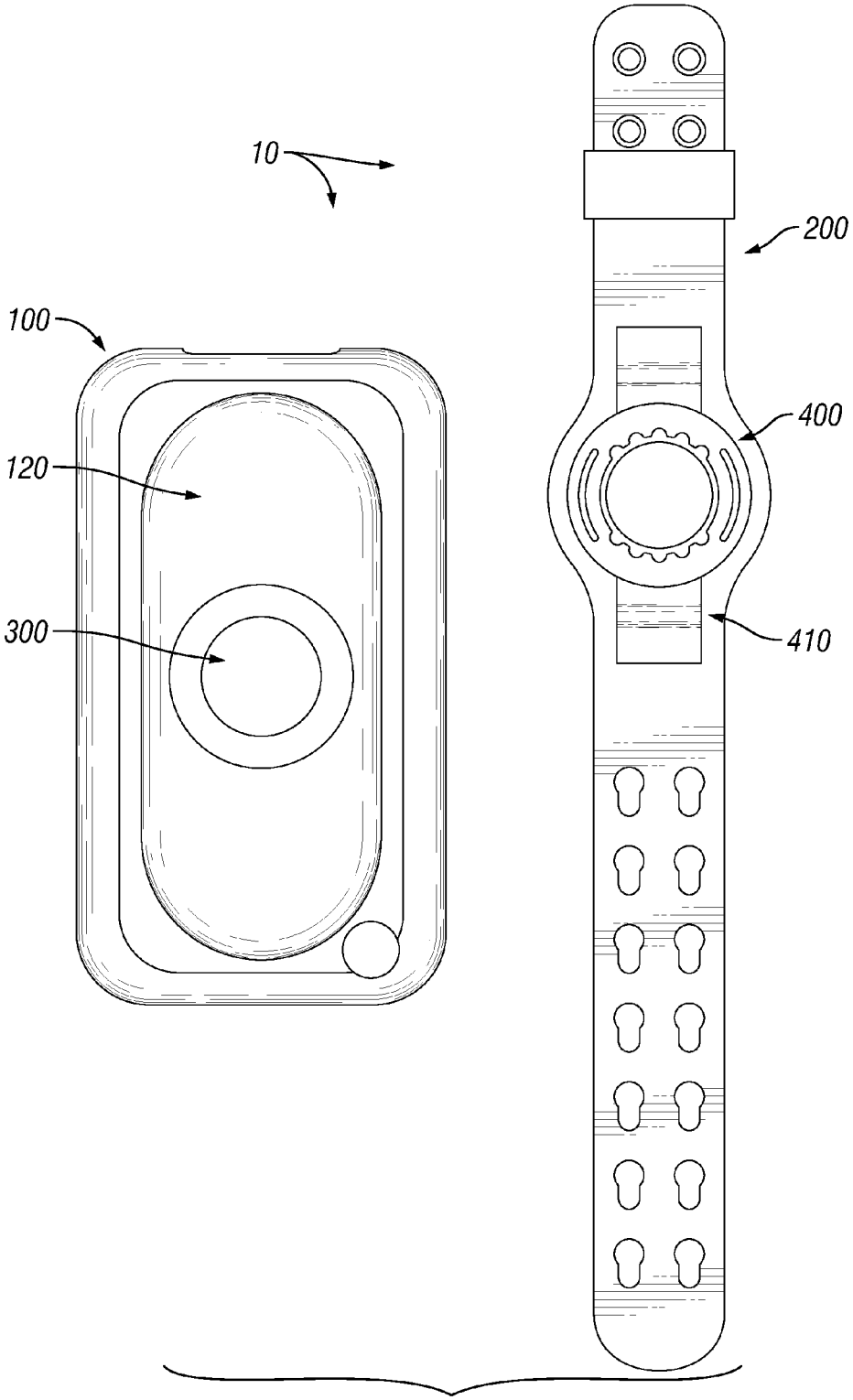
FIG. 7 is a diagrammatic perspective view of a further embodiment of the invention from the back with the shell case disengaged, showing the socket assembly on the shell case and the spring assembly on the wrist strap.

FIG. 3 illustrates the first embodiment the invention 10 with the socket assembly 300 on the wrist strap 200. The socket assembly 300 is shown in an exploded view. In this embodiment, the socket assembly 300 is fixed to the wrist strap 200 and does not rotate. The spring assembly 400 is attached to the shell case 100 and selectively rotates the shell case 100 to a desire position. In FIG. 7, as explained hereinbelow, the socket assembly 300 is attached to the shell case 100 and selectively rotates the shell case 100 when connected to the spring assembly 400 fixed on the wrist strap 200.

Referring to FIG. 3, the crown 350 and a ring 310 form the socket assembly 300 in the first embodiment that connects to the spring assembly 400 on the shell case 100. The wrist strap 200, having a pair of end portions 200E, 200F, has an aperture 220 between the end portions. The ring 310 has an inner disk 320, and a flat outer flange 330, having an inside regularly-shaped circular opening, the inner disk 320 attaching to and sitting on the outer flange 330. The inner disk 320 has an inside edge 320E, having a plurality of smooth, flat semicircular ridges 322, which do not project beyond the inside of the circular opening 340 of the flange 330 that defines the opening in the ring 310. The edge 320E has a plurality of grooves interposed between the ridges 322.

FIG. 3 shows the spring assembly 400 attached to the platform 120 of the shell case 100. The spring assembly 400 has a pair of tabs 410, and a circular housing 420 with a bottom base 422, a top 424 having a round side 424S connecting the top 424 to the base 422. In the first embodiment, the base 422 of the housing 420 is attached to the platform 120 of the shell case 100, securing the spring assembly 400 to the shell case 100. The housing 420 has an inside with a spring and an internal bottom channel diametrally formed beneath the bottom base 422 with a pair of diametrally opposing notches 426 to accommodate the pair of tabs 400, allowing the tabs 410 to travel through the notches 426 into the channel. The top 424 of the housing 420 has a smaller diameter than the base 422 and concentrically sits on the bottom base 422. The round side 424S has two opposing windows 428 aligned with the channel in the base 422.

Figure 4:
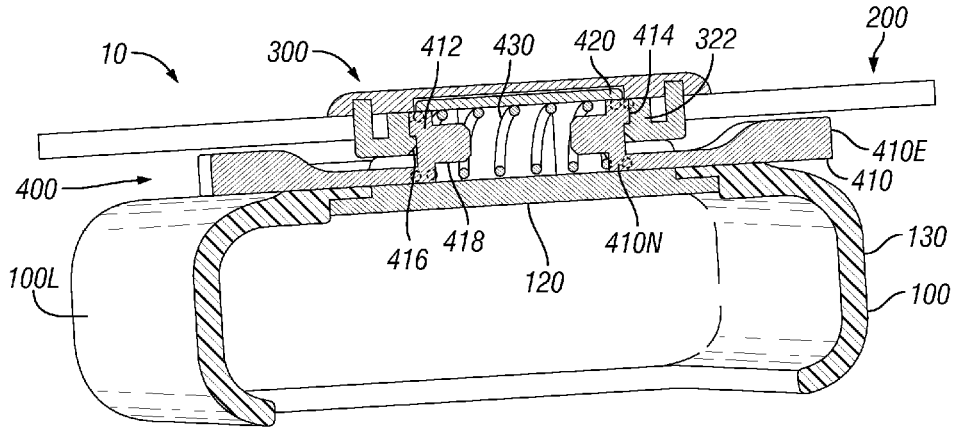
FIG. 4 is a cross-sectional center axial view of the invention showing the socket assembly interlockingly connecting to the spring assembly.

Details of the inside of the housing are clearly illustrated in FIG. 4, in a cross-sectional axial view of the fully assembled invention 10. The socket assembly 300 on the wrist strap 200 is interlockingly connected to the spring assembly 400 on the shell case 100 in the first embodiment. The pair of tabs 410 each have an inside end 410N and an outer end 410E. On the inside ends 410N of the tabs 410, inside the housing 420, is a pair of short rods 418, one on each inside end 410N that fit inside the spring 430. The spring 430 and the inside ends 410N of the tabs 410 are in the housing 420.

In the first embodiment, the spring assembly 400 is fixed onto the rear platform 120 of the shell case 100. The spring assembly 400 does not rotate with respect to the shell case 100, but is fixed in place such that the shell case 100 rotates with the spring assembly 400. The spring assembly 400 is inserted inside the socket assembly 300 and the pair of tabs 410 of the spring assembly 400 locks the spring assembly 400 in place. As shown in FIG. 3, each inside end 410N of the tabs 410 has a curved crescent-shaped catch 412 biased inward toward the opposing tab, with a plurality of grooves 414 curving towards the outer ends 410E of the tabs 410. Referring to FIG. 4, beneath the grooves on the catch are a pair of recesses 416, a recess on each catch, allowing the grooves to extend through the windows in the housing to engage the ridges 322 on the edge of the inner disk 320 in the socket assembly 300 and hooking around the side of housing 424S below the windows 428. The spring 430 in the housing 420 is between the inside ends 410N of the tabs 410 and maintains a force against the catches 412, keeping the tabs 400 fully extended in the locking position. The spring 430 maintains the engagement of the grooves 414 of the tabs 410 with the ridges 322 on the inner disk 320 of the socket assembly 300. As illustrated in FIG. 5, the shell case 100 has a plurality of sides, a pair of parallel longs sides 100L and a pair of parallel short sides 100S forming a rim 130. As shown in FIG. 4, the outer ends 410E of the tabs 410 extend out of the notches 426 in the housing bottom 422 and to the rim 130 on the long sides 100L of the shell case 100 so that the user can easily squeeze the tabs 410 together to remove the device 12 from the wrist strap 200.

FIG. 7 shows the further embodiment of the invention 10. The spring assembly 400 is attached directly on the wrist strap 200, with the tabs 410 parallel lengthwise to the strap 200. The socket assembly 300, with the ridges and grooves as explained hereinabove, is inserted in the rear platform 120 of the shell case 100, the shell case 100 having a cavity to accommodate the socket assembly 300. The assemblies interlock in the same manner as described hereinabove. The socket assembly 300 selectively rotates the shell case 100 when connected to the spring assembly 400 fixed on the wrist strap 200.

FIG. 3 shows a non-limiting example of a method of attaching the socket assembly 300 to the wrist band 200. The aperture 220 on the wrist strap 200 is essentially circular with an edge 220E. Adjacent to the edge 220E is a plurality of small openings 222. Located on the flange 330 is a plurality of vertical pins 332, each having a bottom 332B attached to the flange 330 and a top 332T. The small openings align with the plurality of pins on the flange 332 of the ring 310. To attach the socket assembly 300 to the wrist strap 200, the ring 310 is placed on the outside 200X of the strap 200, and the plurality of pins 332 on the flange 330 of the ring 310 are placed through the small openings 222 surrounding the aperture 220. The crown 350 has a plurality of slots on the inside surface, which are not shown in the drawing. The slots align with the pins 310 on the ridge 305 of the ring 300. The crown 350 is snaps into place on the inside 200N of the strap 200, inserting the tops 332T of the pins 332 into corresponding slots on the inside surface of the cap 350.

As illustrated in FIG. 5 and FIG. 6, the device 12 typically has a front 12F and a back connected by a plurality of edges 12S, the front 10F having typically a touch or front display screen 14, a virtual or actual keyboard, a receiver speaker 16 for the phone, optionally a control button 18. The shell case 100 has a back 100R having a border 100R which covers the back of the device. The shell case 100 also has an open front 100F and a flexible rim 130 attached to the border of the back 100R, the flexible rim 130 having a curved edge 130E extending inwardly and defining the open front 100F. The flexible rim 130 fits around the side edges 12S of the device 12 with having a curved edge extending inwardly and defining the open front 12F of the device, overlapping the edges on the front 12F sufficiently to hold the device 12 in place. The flexible rim 130 does not interfere with the display screen 14 or user interface features such as the keyboard. Suitable apertures for attaching headphones, recharging cable, and other peripheral devices are in the flexible rim 130, but are not shown. The user has a pair of wrists 20, each with a hand 30 with a set of fingers 32 and a thumb 32, the hand 30 distally attached to the wrist 20. Wearing the wrist holder 10 on a first wrist 20 allows the user to use the hands 30 and fingers 32 of the wrists 20 for tasks other than holding the handheld computing device.

To rotate the shell case 100 to a desired position, in the first embodiment the spring assembly 400 is rotated with respect to the socket assembly 300. In the further embodiment, the socket assembly rotates with respect to the spring assembly 400. In both embodiments, to rotate the shell case 100, grasping the rim 130 of the shell case 110 and twisting to slightly compress the spring in the spring assembly 400, forcing the grooves on the inside tab ends 410N slightly away from the ridges in the socket assembly, allowing one assembly to rotate with respect to other assembly.

To release the shell case 100, the pair of tabs 410 is squeezed towards each other, until the grooves on the tabs 410 completely disengage from the ridges on the inner ring of the socket assembly so that the two assemblies are completely disengaged from each other. The user pulls the shell case 100 straight out from the wrist strap 200, separating the socket assembly 300 from the spring assembly 400. To reattach the shell case 100, the socket assembly snaps into place inside the spring assembly 400, the grooves on the tabs 410 of the spring assembly 400 engaging the ridges of the socket assembly.

FIG. 1 demonstrates the adjustable elements of the wrist strap 200. The wrist strap 200 has a pair of end portions, including the first end portion 200E and the second end portion 200F. In one embodiment, the first end portion 200E contains a plurality of openings 210, and a second end portion 200F containing a plurality of fastening pegs 240, forming a poly-snap closure when joined. The wrist strap 200 has a keeper loop 230 on the second end portion 200F that holds the first end portion 200E snugly against the wrist strap 200. It is understood that numerous variation in the method of adjusting the length of the strap as well as closures for the pair of end portions are possible within the inventive concept. For example, the closure can be, but is not limited to, a standard tang buckle, a deployment clasp, or hook and loop fastener material.

To use the invention 10 to maintain the handheld device on the wrist, as illustrated in FIG. 3, the user first places the handheld device in the shell case 100, securing it with the flexible rim. The user places the wrist strap 200 on the wrist and selectively adjusts the strap to fit comfortably. The user attaches the shell case 100 with the device onto the wrist strap 200 by snapping the spring assembly 400 onto the socket assembly 300, interlocking the two assemblies by engaging the grooves 414 on the tabs 410 of the spring assembly 400 with the ridges 322 of the socket assembly 300. Alternatively, the user attaches the device to the wrist strap 200 as described hereinabove and places the strap 200 on the wrist after connecting the assemblies.

The user selectively rotates the device into a desired position by grasping the rim 130 of the shell case 100 and twisting to slightly compress the spring in the spring assembly 400, forcing the grooves 414 on the tab ends 410N slightly away from the ridges 322 in the socket assembly, allowing one assembly to rotate with respect to the other assembly. The user operates the device normally while attached to the wrist strap 200 without having to detach the device unless desires.

The user selectively detaches the shell case 100 with the device from the wrist band 200 by placing a forefinger of the hand on the second wrist on the outer end 410E of a first tab 410 and the thumb of the hand on the second wrist on the outer end 410E of a second tab 410 and squeezing the tabs 410 together, completely disengaging the ridges 322 on the socket assembly 300 from the grooves 414 on the tabs 410 on the spring assembly 400 and lifting the shell case 100 off of the wrist strap 200.

In the embodiments illustrated, the user places the wrist strap 200 around the wrist and selectively adjusts the wrist strap by inserting a pair of poly-snap fastening pegs on the second end portion 200F of the wrist strap 200 into a pair of openings 210 on the first end 200E, forming a poly-snap closure when joined. It is understood that a poly-snap closure is a non-limiting example of how the wrist strap is adjustably fastened within the inventive concept. Other means of adjustably fastening the wrist strap 200 are well-known to those of ordinary skill and are beyond the scope of this discussion.

In conclusion, herein is presented a wrist holder for a handheld device such as a smartphone or PDA that allows the user to easily rotate the device between landscape and portrait positions, as well as quickly connecting to and disconnecting the device from the holder. The invention is illustrated by example in the drawing figures, and throughout the written description. It should be understood that numerous variations are possible, while adhering to the inventive concept. Such variations are contemplated as being a part of the present invention.

What is claimed is:

1. A wrist holder for a handheld computing device, comprising:

a wrist strap, the wrist strap having a pair of ends portions and a means for adjustably fastening the ends together;

a shell case, the shell case having an open front, a back having a border, the shell case having a flexible rim attached to the border of the back, the flexible rim having a curved edge extending inwardly and defining the open front to contain the handheld computing device within the shell case; and a pair of interlocking assemblies, a first assembly attached to the wrist strap and a second assembly attached to the back of the shell case, the assemblies selectively connecting the shell case to the wrist strap, the pair of assemblies including a spring assembly and a socket assembly, the socket assembly having a inner disk with a inside edge defining a circular opening, the inside edge having a plurality of ridges, the spring assembly having a spring, a housing and a pair of tabs, each tab having an inside end and an outer end, the inside end having a plurality of grooves, the housing having a top, a side, the side having a pair of diametrally opposing windows and a diametral bottom channel, the inside ends of the tabs traveling through the channel into the housing, the spring inside the housing between the inside ends of the tabs extending the grooves on the inside ends through the windows, the grooves, selectively engaging the ridges on the socket assembly, interlockingly connecting the wrist strap to the shell case when the first assembly on the back of the shell case snaps on the second assembly on the strap, the second assembly on the shell case rotating with respect to the first assembly on the strap.

2. The wrist holder for a handheld computing device as described in claim 1, wherein the handheld device is functional in a portrait position and a landscape position, and the second assembly on the shell case rotates with respect to the first assembly on the wrist strap, selectively allowing the device to rotate between the landscape position and the portrait position.

3. The wrist holder for a handheld computing device, as described in claim 2, wherein the socket assembly is attached to the back of the shell case.

4. The wrist holder for a handheld computing device, as described in claim 3, wherein the spring assembly is attached to the wrist strap.

5. The wrist holder for a handheld computing device, as described in claim 4, wherein the tab ends of the spring assembly are aligned with the end portions of the wrist strap.

6. The wrist holder for a handheld computing device, as described in claim 5, wherein the wrist strap has a first end portion and a second end portion, the first end portion has a plurality of openings engaging the second end portion, the second end portion having a plurality of fastening pegs to adjustably form a poly-snap closure when the fastening pegs are selectively inserted in the openings.

7. A wrist holder for a handheld computing device, comprising:

a wrist strap, the wrist strap having a pair of ends and a means for adjustably fastening the ends together;

a shell case, the shell case having an open front, a back having a border, a flexible rim attached to the border of the back, the flexible rim having a curved edge extending inwardly and defining the open front to contain the handheld computing device within the shell case; and a socket assembly, the socket assembly attached to the back of the shell case, the socket assembly having a inner disk with a inside edge defining a circular opening, the inside edge having a plurality of ridges; and a spring assembly, the spring assembly attached to the wrist strap, the spring assembly having a spring, a housing and a pair of tabs, each tab having an inside end and an outer end, the inside end having a plurality of grooves, the housing having a top, a side, the side having a pair of diametrally opposing windows and a diametral bottom channel, the inside ends of the tabs traveling through the channel into the housing, the spring inside the housing between the inside ends of the tabs extending the grooves on the inside ends through the windows and selectively engaging the ridges on the socket assembly attached to the shell case to interlockingly connect the wrist strap to the shell case when the socket assembly is snapped on the spring assembly, the spring assembly allowing the socket assembly on the shell case to selectively rotate with respect to the spring assembly on the strap.

8. The wrist holder for a handheld computing device, as described in claim 7, wherein the tab ends of the spring assembly are aligned with the end portions of the wrist strap.

9. The wrist holder for a handheld computing device as described in claim 8, wherein the handheld device is functional in a portrait position and a landscape position, and the socket assembly on the shell case rotates with respect to the spring assembly on the wrist strap, selectively allowing the device to rotate between the landscape position and the portrait position.

10. The wrist holder for a handheld computing device, as described in claim 9, wherein the wrist strap has a first end portion and a second end portion, the first end portion has a plurality of openings engaging the second end portion, the second end portion having a plurality of fastening pegs to adjustably form a poly-snap closure when the fastening pegs are selectively inserted in the openings.

11. A method of maintaining a handheld computing device on a wrist of a user with a wrist holder, the wrist holder having an adjustable wrist strap, a shell case, the shell case having a back, the shell case containing the handheld computing device, the wrist holder also having a socket assembly, the socket assembly attached to the back of the shell case, a spring assembly, the spring assembly attached to the wrist strap, the spring assembly having a pair of tabs for selectively engaging the socket and a spring for biasing the tabs towards a locked position, comprising:

attaching the wrist strap to the wrist of the user;

connecting the wrist strap to the shell case by snapping the socket assembly on the back of the shell case;

rotating the handheld computing device with respect to the wrist strap on the wrist by grasping the rim of the shell case and twisting; and selectively detaching the handheld computing device from the wrist strap by squeezing the tabs together to compress the spring to release the socket, and lifting the shell case off of the wrist strap.

12. The method of maintaining a handheld computing device on a wrist with a wrist holder as described in claim 11, wherein the step of snapping the socket assembly onto the spring assembly is preceded by the step of placing the device in the shell case through the open front with the flexible rim securing the device.

13. The method of maintaining a handheld computing device on a wrist with a wrist holder as described in claim 12, wherein the ridges of the socket assembly engage the grooves of the spring assembly on the back of the shell case, interlockingly connecting the wrist strap to the shell case.

14. The method of maintaining a handheld computing device on a wrist with a wrist holder as described in claim 13, wherein the handheld computing device rotates by grasping the rim and twisting, slightly compressing the spring in the spring assembly, forcing the grooves on the tab ends slightly away from the ridges in the socket assembly.

15. The method of maintaining a handheld computing device on a wrist with a wrist holder as described in claim 14, wherein the squeezing the tabs on the spring assembly together to compress the spring disengages the ridges on the socket assembly from the grooves on the tabs on the spring assembly completely, and shell case lifts off the wrist strap, selectively disengaging the device from the wrist strap.

* * * * *